US005747105A

United States Patent [19]

Haubert

[11] Patent Number: 5,747,105

[45] Date of Patent: May 5, 1998

[54] TRAVERSING NOZZLE FOR APPLYING GRANULES TO AN ASPHALT COATED SHEET

[75] Inventor: Thomas D. Haubert, Columbus, Ohio

[73] Assignee: Owens Corning Fiberglas Technology Inc., Summit, Ill.

[21] Appl. No.: 640,641

[22] Filed: Apr. 30, 1996

[51] Int. Cl.[6] ..... B05D 1/02

[52] U.S. Cl. ..... 427/186; 427/187; 427/188; 427/202

[58] Field of Search ..... 427/186, 187, 427/188, 180, 196, 202, 480, 482; 118/308, 323, 311; 134/15; 239/97, DIG. 1, 226, 379; 222/526, 409, 174

[56] References Cited

U.S. PATENT DOCUMENTS

| | | |
|---|---|---|
| 83,718 | 3/1868 | Brown . |
| 89,471 | 3/1869 | Streeter et al. . |
| 93,191 | 8/1869 | Topping . |
| 978,333 | 12/1910 | Overbury . |
| 1,154,334 | 9/1915 | Overbury . |
| 1,214,658 | 2/1917 | Dun Lany . |
| 1,264,831 | 4/1918 | McKay . |
| 1,295,360 | 2/1919 | Overbury . |
| 1,345,627 | 7/1920 | Overbury . |
| 1,376,092 | 4/1921 | Heppes . |
| 1,379,368 | 5/1921 | Speer . |
| 1,445,991 | 2/1923 | Butterick . |
| 1,456,224 | 5/1923 | Currier . |
| 1,583,563 | 5/1926 | Abraham . |
| 1,774,988 | 9/1930 | Maclean . |
| 1,791,571 | 2/1931 | Overbury . |
| 1,820,005 | 8/1931 | Maclean . |
| 1,916,095 | 6/1933 | Cumfer . |
| 1,956,285 | 4/1934 | Harshberger . |
| 1,967,419 | 7/1934 | Moone . |
| 2,044,788 | 6/1936 | Harshberger et al. . |
| 2,058,578 | 10/1936 | Eckert . |

(List continued on next page.)

FOREIGN PATENT DOCUMENTS

| | | |
|---|---|---|
| 0107626 | 5/1984 | European Pat. Off. . |
| 0125585 | 11/1984 | European Pat. Off. . |
| 0224621 | 6/1987 | European Pat. Off. . |
| 294777 | 6/1958 | Finland . |
| 2118072 | 1/1984 | United Kingdom . |
| 2158813 | 11/1985 | United Kingdom . |
| WO 94/01222 | 1/1994 | WIPO . |
| WO 95/12457 | 5/1995 | WIPO . |
| WO 95/12458 | 5/1995 | WIPO . |

OTHER PUBLICATIONS

Principles of Powder Mechanics by R.L.. Brown and J.C. Richards—Copyright© 1970 pp. 186 through 193.

Fluidization Engineering by Daizo Kinii and Octave Levenspiel, Copyright© 1991—Chapter 1.

Instructions for Laying 11×32 Inch Strip–Shingles In Varied Designs, Copyrighted 1921 by The Ruberoid Co. Formerly The Standard Paint Company.

Fluidization Engineering by Dazio Kunii and Octave Levenspiel, Copyright© 1991—Chapter 3.

*Primary Examiner*—Benjamin Utech
*Assistant Examiner*—Fred J. Parker
*Attorney, Agent, or Firm*—C. Michael Gegenheimer; Ted C. Gillespie

[57] ABSTRACT

A method for applying granules to a moving asphalt coated sheet includes providing a nozzle for discharging granules onto a sheet having first and second edges. The nozzle is mounted for movement along a path which traverses the sheet and extends beyond the first and second edges to define first and second extension locations beyond the edges. The nozzle is moved along the path, and the discharge of granules is begun while the nozzle is adjacent or opposite the first extension location, and the discharge of the granules is ended after the nozzle has traversed the asphalt coated sheet and reached the second extension location so that the beginning and ending of the granule discharge do not occur between the first and second edges. The path and the speed of the nozzle can be adjusted so that the deposit of the granules applied to the sheet has a predetermined shape.

20 Claims, 5 Drawing Sheets

U.S. PATENT DOCUMENTS 2,074,131 3/1937 Penley et al. ..... 427/188
2,081,620 5/1937 Fether .
2,111,761 3/1938 Eckert .
2,122,739 7/1938 Dudleston .
2,129,288 9/1938 Shattuck .
2,157,944 5/1939 Walton .
2,163,757 6/1939 Maclean et al. .
2,175,226 10/1939 Slayter .
2,253,652 8/1941 Ritter .
2,302,183 11/1942 Burns .
2,316,093 4/1943 MacNutt .
2,348,223 5/1944 Fapesh .
2,359,029 9/1944 Goldberg .
2,430,534 11/1947 Rodli .
2,523,759 9/1950 Grant .
2,605,036 7/1952 Cozzoli .
2,661,303 12/1953 Fasold et al. .
2,676,155 4/1954 Farris .
2,728,685 12/1955 Muench .
2,771,387 11/1956 Kleist et al. .
2,851,401 9/1958 Payne .
2,905,569 9/1959 Zitke .
2,949,206 8/1960 Figge .
2,978,149 4/1961 Rosen .
2,979,235 4/1961 Greaves .
3,150,022 9/1964 Vida .
3,194,856 7/1965 Palmer .
3,231,453 1/1966 Smith .
3,305,276 2/1967 Weber .
3,332,830 7/1967 Tomlinson et al. .
3,506,111 4/1970 Eppenberger .
3,540,974 11/1970 Broadhurst .
3,586,069 6/1971 Vest et al. .
3,661,189 5/1972 Bowser et al. .
3,693,672 9/1972 Hiland .
3,716,082 2/1973 Green .
3,797,890 3/1974 Walters .
3,837,540 9/1974 Wagener .
3,858,628 1/1975 Bendle .
3,884,401 5/1975 Winkler .
3,886,021 5/1975 Breckenfelder .
3,919,823 11/1975 Bradley .
3,964,793 6/1976 Volpeliere .
3,985,161 10/1976 Nelson ..... 239/185
4,045,584 8/1977 Jones et al. .
4,067,623 1/1978 Klein et al. .
4,178,974 12/1979 Levin .
4,212,331 7/1980 Benatar .
4,233,100 11/1980 Cunningham et al. .
4,274,243 6/1981 Corbin et al. .
4,295,445 10/1981 Kopenhaver .
4,333,279 6/1982 Corbin et al. .
4,352,837 10/1982 Kopenhaver .
4,359,873 11/1982 Miller .
4,399,186 8/1983 Lauderback .
4,427,040 1/1984 Taylor .
4,468,430 8/1984 Ruede .
4,478,869 10/1984 Brady et al. .
4,516,702 5/1985 Schmidt .
4,550,755 11/1985 Vredenburg, Sr. .
4,552,091 11/1985 Feder .
4,573,504 3/1986 Rosenström .
4,583,486 4/1986 Miller .
4,600,603 7/1986 Mulder .
4,614,213 9/1986 Englin .
4,647,471 3/1987 Jenkins .
4,668,323 5/1987 Lenards et al. .
4,688,610 8/1987 Campbell .
4,735,241 4/1988 Spiess .
4,738,287 4/1988 Klinkel .
4,800,102 1/1989 Takada .
4,815,414 3/1989 Duffy et al. .
4,851,248 7/1989 Simelunas et al. .
4,872,969 10/1989 Sechrist .
4,873,103 10/1989 Corders .
4,873,937 10/1989 Binder et al. .
4,907,720 3/1990 Henson et al. .
4,943,163 7/1990 Steele .
4,955,270 9/1990 Volk, Jr. .
4,974,646 12/1990 Martin et al. .
4,976,296 12/1990 Pope .
5,016,687 5/1991 Kawamura .
5,098,557 3/1992 Hirschler et al. .
5,109,893 5/1992 Derby .
5,186,980 2/1993 Koschitzky .
5,217,554 6/1993 Stroppiana .
5,234,037 8/1993 Derby .
5,248,524 9/1993 Soderlund .
5,275,215 1/1994 Derby .
5,283,080 2/1994 Lamb et al. .
5,323,819 6/1994 Shade .
5,332,133 7/1994 Murata et al. ..... 222/630
5,347,785 9/1994 Terrenzio et al. .
5,380,390 1/1995 Tselesin .
5,405,647 4/1995 Grubka et al. ..... 427/188
5,488,807 2/1996 Terrenzio et al. .
5,520,889 5/1996 Burton et al. .
5,547,707 8/1996 Haubert .

TRAVERSING NOZZLE FOR APPLYING GRANULES TO AN ASPHALT COATED SHEET

TECHNICAL FIELD

This invention pertains to the handling of continuous strips of asphalt material, such as asphalt material suitable for use as roofing membranes and roofing shingles. In one of its more specific aspects, this invention relates to controlling the application of granules to asphalt strip material.

BACKGROUND ART

A common method for the manufacture of asphalt shingles is the production of a continuous strip of asphalt shingle material followed by a shingle cutting operation which cuts the material into individual shingles. In the production of asphalt strip material, either an organic felt or a glass fiber mat is passed through a coater containing liquid asphalt to form a tacky asphalt coated strip. Subsequently, the hot asphalt strip is passed beneath one or more granule applicators which apply the protective surface granules to portions of the asphalt strip material. Typically, the granules are dispensed from a hopper at a rate which can be controlled by making manual adjustments on the hopper In the manufacture of colored shingles, two types of granules are employed. Headlap granules are granules of relatively low cost for portions of the shingle which are to be covered up. Colored granules or prime granules are of relatively higher cost and are applied to the portion of the shingle which will be exposed on the roof.

To provide a color pattern of pleasing appearance the colored shingles are provided in different colors, usually in the form of a background color and a series of granule deposits of different colors or different shades of the background color. These highlighted series of deposits, referred to as blend drops, are typically made from a series of granule containers by means of feed rolls. The length and spacing of each blend drop on the sheet is dependent on the speed of the feed roll, the relative speed of the sheet and the length of time during which the drop is made.

Not all of the granules applied to the hot, tacky, asphalt coated strip adhere to the strip, and, typically, the strip material is turned around a slate drum to invert the strip and cause the non-adhered granules to drop off. These non-adhered granules, which are known as backfall granules, are usually collected in a backfall hopper. The backfall granules are eventually recycled and discharged onto the sheet.

One method of applying granules to the moving sheet involves discharging the granules from feed rolls which are hoppers having a fluted roll. The fluted roll is rotated to discharge the blend drop granules onto the asphalt sheet. The roll is ordinarily driven by a drive motor, the roll being positioned in the drive or non-drive position by means of a brake-clutch mechanism. This mechanical action required to discharge the blend drop granules is burdened with inherent limitations which prevent the discharge of blend drop granules from reaching an instantaneous constant flow rate. Consequently, there is a limit to the sharpness of the blend drops on the shingle. As shingle manufacturing lines go up in speed the lack of sharpness is accentuated, and the distinction between the blend drop and the background color becomes fuzzy. The lack of sharpness puts a severe limitation on the kinds of designs and color contrasts which can be applied to the shingle.

Another method of applying granules to the moving sheet involves discharging granules from an aperture in a nozzle.

The granules are fed to the nozzle from a hopper. The discharge of granules from the nozzle is controlled by regulating the flow of granules through the aperture. Generally, the aperture is opened to allow the granules to be discharged from the nozzle and closed to stop the discharge. The flow from the aperture may be aided by gravity, pneumatic pressure or both. In any case, the discharge of granules from the aperture takes time to reach a constant rate of flow. A constant flow rate is required to produce a deposit of granules on the asphalt sheet having a uniform distribution. The variation in the flow rate of the blend drop granules which occurs between the time the aperture is first opened and when a constant flow rate is achieved, produces an unwanted, nonuniform distribution of granules on the asphalt sheet. A similar variation or nonuniform distribution occurs when the aperture is closed to stop the discharge of blend drop granules.

It is desired to provide an improved method for discharging blend drop granules onto the moving sheet to produce a deposit having a uniform distribution of granules.

DISCLOSURE OF THE INVENTION

There has now been developed a method for applying granules to a moving asphalt coated sheet where the deposit is generally uniform, having generally sharp, distinct edges. In general the granules are discharged by a nozzle which traverses the asphalt coated sheet, and the flow of granules onto the sheet is kept uniform. The method of the invention includes providing a nozzle for discharging granules onto a sheet having first and second edges. The nozzle is mounted for movement along a path which traverses the sheet and extends beyond the first and second edges to define first and second extension locations beyond the edges. The nozzle is moved along the path, and the discharge of granules is begun while the nozzle is adjacent or opposite the first extension location, and the discharge of the granules is ended after the nozzle has traversed the asphalt coated sheet and reached the second extension location so that the beginning and ending of the granule discharge do not occur between the first and second edges.

In a specific embodiment of the invention the path is a straight line at an acute angle to the machine direction. Alternatively, the path can be a curved line or a path of any other configuration to produce a deposit of any desired shape. During the discharge, the nozzle can be moved in the machine direction at the same speed as the sheet moves to produce a deposit of granules which is in a line generally perpendicular to the machine direction. The path and the speed of the nozzle can be adjusted so that the deposit of the granules applied to the sheet has a predetermined shape.

According to this invention, there is also provided a method for producing a shingle comprising providing an asphalt coated sheet moving in a machine direction and having at least a first and second headlap lane and a prime lane therebetween, the prime lane and headlap lanes extending in the machine direction, providing a discharge nozzle for discharging blend drop granules onto the sheet, discharging the blend drop granules while moving the nozzle in a path that is transverse to the sheet, where the discharging is begun when the nozzle is opposite the first headlap lane and ended after the nozzle has traversed the prime lane and is opposite the second headlap lane, and discharging background granules onto the sheet.

Various objects and advantages of this invention will become apparent to those skilled in the art from the following detailed description of the preferred embodiment, when read in light of the accompanying drawings.

BEST MODE FOR CARRYING OUT THE INVENTION

Figure 1:
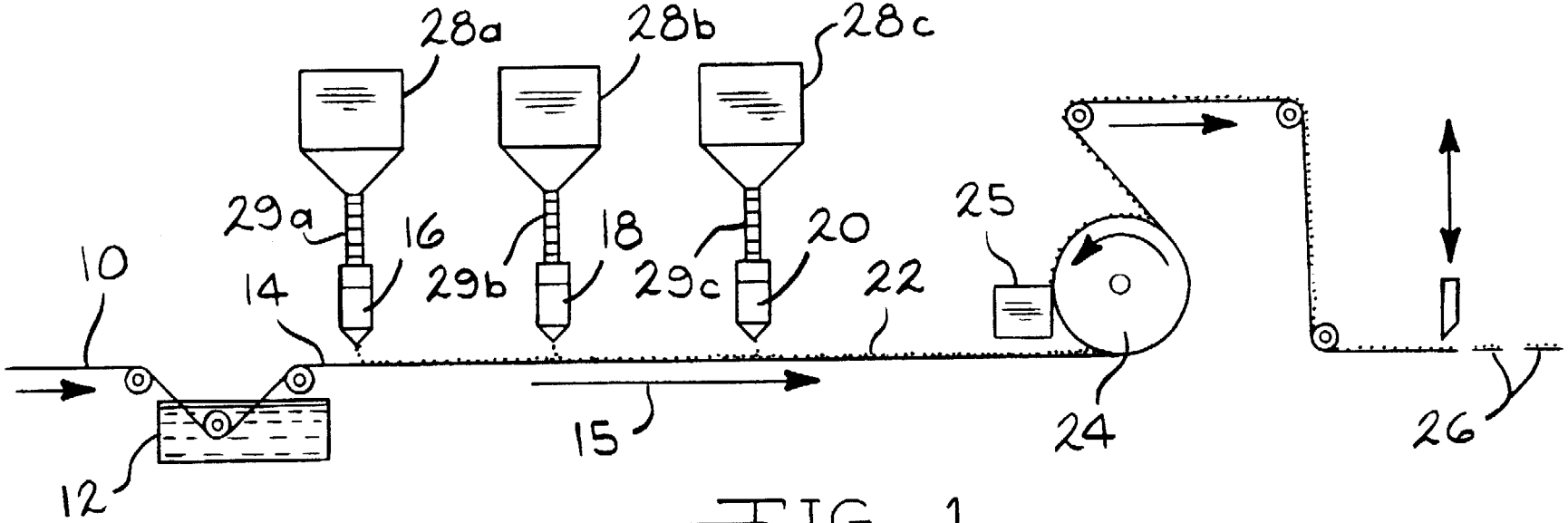
FIG. 1 is a schematic view in elevation of apparatus for producing shingles according to the principles of the invention.
Figure 2:
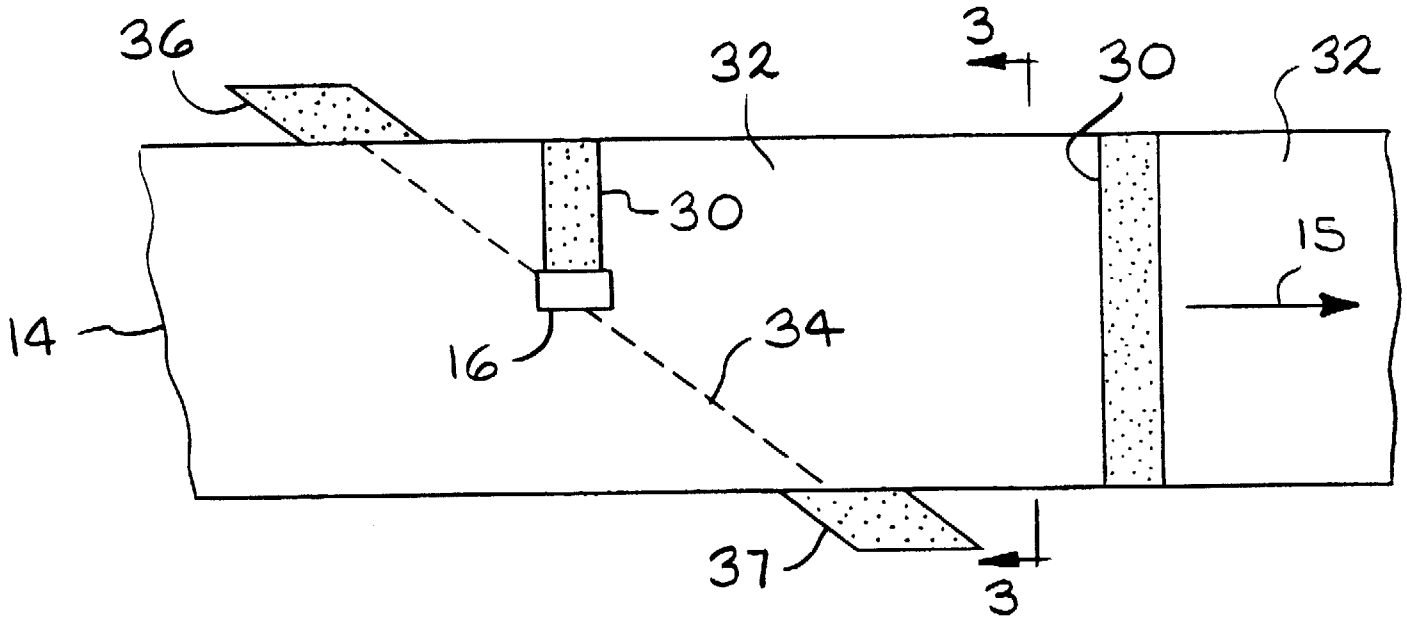
FIG. 2 is a schematic plan view of a portion of the asphalt coated sheet showing the blend drop granules being applied to the sheet according to the principles of the invention.

As shown in FIGS. 1 and 2, the base shingle mat 10, preferably a fiberglass mat, is passed through asphalt coater 12 to form an asphalt coated sheet 14, herein referred to as the sheet. The sheet moves at the machine speed in the machine direction as indicated by arrow 15. A series of granule dispensing nozzles 16, 18, and 20 discharge granules onto the sheet to form a granule-coated asphalt sheet 22. The granule-coated asphalt sheet is turned around a slate drum 24 so that the excess granules can drop off, where they are collected by the backfall hopper 25. The granule-coated asphalt sheet is cut into shingles 26. The granules can be dropped from apertures (not shown) in the bottom of the nozzles using the force of gravity, or discharged from the nozzles using pneumatic pressure or any other suitable means. The granules are fed from hoppers 28*a*, 28*b*, and 28*c* to the dispensing nozzles via hoses 29*a*, 29*b* and 29*c* respectively. The hoppers can be any suitable means for supplying granules to the nozzles. In a preferred design, granule dispensing nozzles 16 and 18 discharge blend drops, and the last nozzle, granule dispensing nozzle 20, discharges background granules.

As shown in FIG. 2, the granules are deposited onto the sheet in an intermittent manner to form a series of prime granule or blend drops 30 which are separated by a series of background color areas, such as background color areas 32. The background color granules are discharged onto the sheet after the blend drops are discharged, as is well known in the art, although this is not shown in FIG. 2. Only nozzle 16 is shown. The nozzle moves in a path, as indicated by dashed line 34, which traverses the moving sheet while discharging the blend drop granules. The path along which the nozzle moves begins in a first extension location 36 which is located beyond one edge of the asphalt sheet. The path ends in a second extension location 37 which is located beyond the other edge of the asphalt sheet. Nozzle 18 also discharges blend drops while moving in a similar path.

While moving along the path 34, the nozzle discharges granules at a predetermined flow rate. To produce a deposit of granules on the sheet having a uniform distribution of granules the nozzle must discharge the granules with a constant flow rate. Variations in the flow rate of the blend drop granules which occur between the time the aperture is first opened and when a constant flow rate is achieved, produce an unwanted, nonuniform distribution of granules. Therefore, the discharge of granules is begun while the nozzle is over or opposite the first extension location 36. The length of the nozzle path located in the extension location is defined so that a constant flow rate from the nozzle is achieved by the time the nozzle is over or opposite the asphalt sheet. This produces a uniform distribution of granules on the asphalt sheet.

Similarly, a variation in the flow rate of the blend drop granules occurs when the aperture is closed to complete the granule discharge. The variation in the flow rate of the blend drop granules which occurs between the time the aperture begins to close and when the flow of granules stops produces an unwanted, nonuniform distribution of granules. Therefore, the discharge aperture of the nozzle remains open until the nozzle has completely traversed the asphalt sheet. The discharge aperture is closed after the nozzle reaches the second extension location. By opening and closing the discharge aperture when the nozzle is over the extension locations, and sizing these extension locations properly, a constant flow rate from the nozzle is maintained while discharging the blend drop granules onto the asphalt sheet. The granules which fall on the extension locations and not on the asphalt sheet are collected by a bin or other suitable means and recycled for later application.

Figure 3:
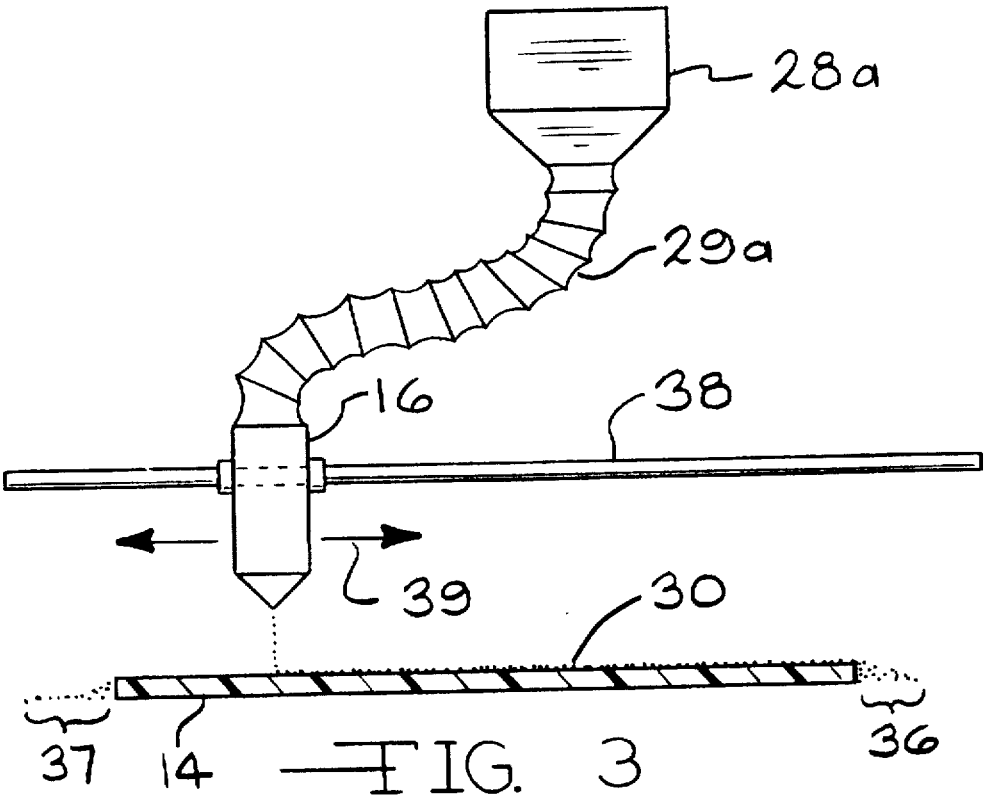
FIG. 3 is a schematic view in elevation of apparatus for dispensing granules taken along line 3—3 of FIG. 2.

As shown in FIG. 3, the nozzle traverses the asphalt sheet while moving along a predetermined path. The path can be varied as will be discussed below. A guide rail 38 can be used to support the nozzle for travel and define the nozzle path. Alternatively, any suitable means for supporting the nozzle and guiding it along a path can be used. The nozzle will travel along the path in both directions as indicated by arrows 39. Preferably, the nozzle will only discharge granules while traveling along the path in one direction and will return to its original position while traveling in the opposite direction. Alternatively, the nozzle could return using a different path.

Figure 4:
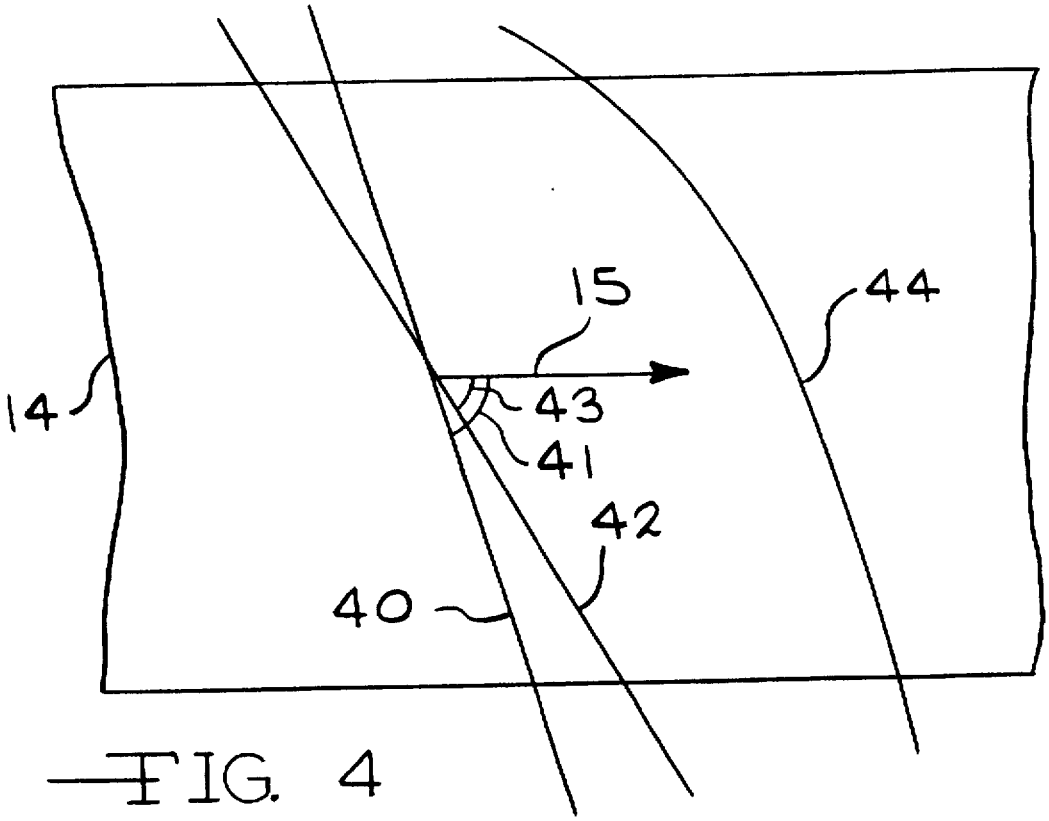
FIG. 4 is a schematic plan view of a portion of the asphalt coated sheet showing alternative paths along which the nozzle can traverse the sheet.

As shown in FIG. 4, the path of the nozzle can be varied to achieve a deposit of granules having a desired, predetermined shape. For example, a deposit of granules which is generally perpendicular to the machine direction can be achieved by adjusting the nozzle path so that while the nozzle traverses the asphalt sheet, it travels at the same speed in a first machine direction as the asphalt sheet. Different asphalt sheet speeds can be accommodated using a fixed nozzle speed along the path by simply adjusting the path angle between the nozzle path and the machine direction 15. For example, a nozzle following path 40 having a path angle 41 will produce a deposit which is generally perpendicular to the machine direction on an asphalt sheet having a first machine speed while path 42 having a path angle 43 can be used for an asphalt sheet having a faster machine speed. The nozzle path does not have to be straight, but can follow a curved path 44 to produce a granule deposit having any desired shape. In addition, the speed of the nozzle along the path can be varied. Also, the flow rate of granules from the nozzle can be varied.

Figure 5:
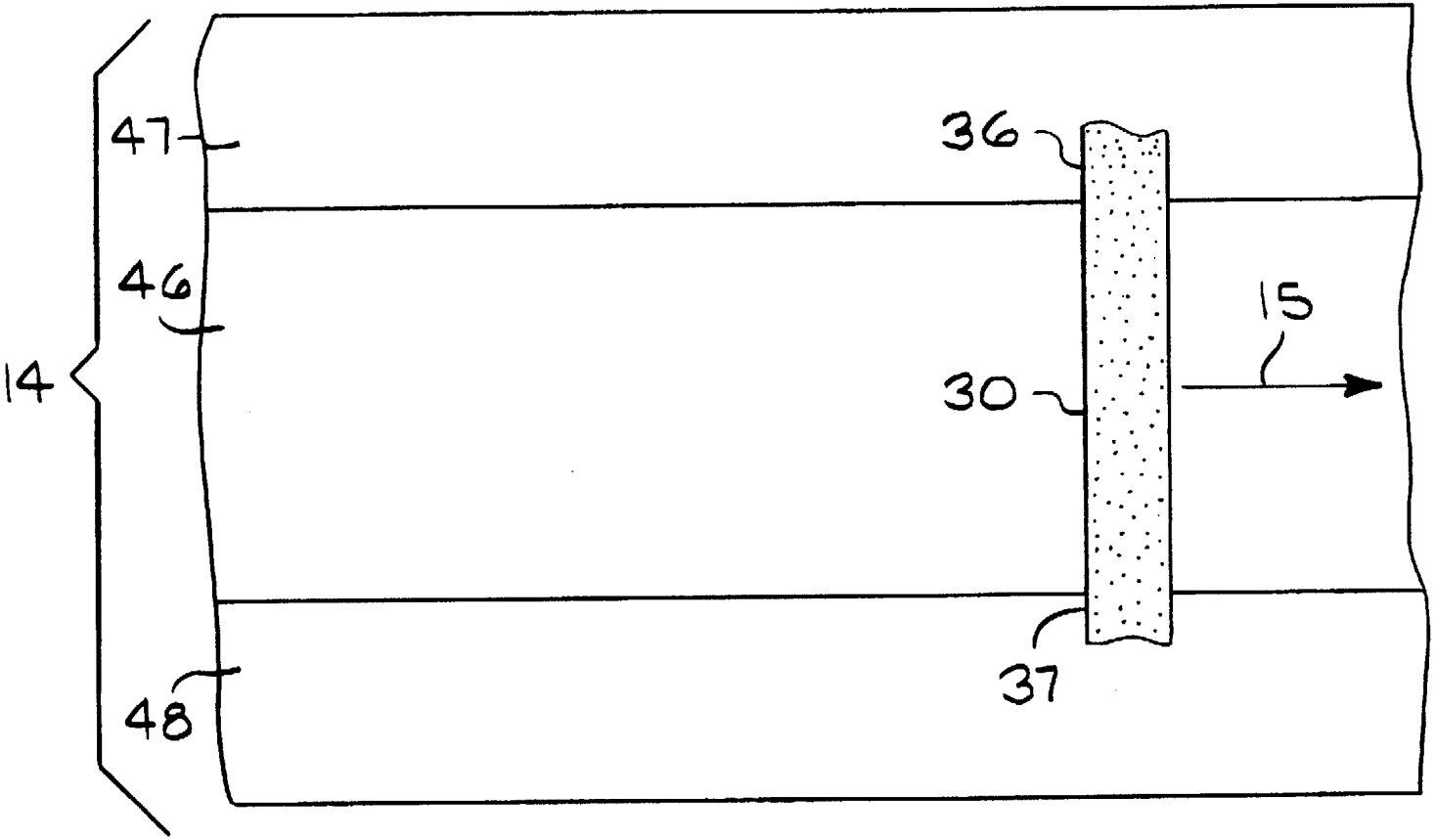
FIG. 5 is a schematic plan view of a portion of the asphalt coated sheet showing the blend drop granules applied to the sheet according to the principles of the invention.

As shown in FIG. 5, the nozzle may discharge granules on only a portion of the asphalt sheet. A prime lane 46 is defined on the asphalt sheet. First and second headlap lanes 47 and 48 are defined on each side of the prime lane. The first and second extension locations 36 and 37 are now located in the first and second headlap lanes respectively. In order to achieve a uniform distribution of granules on the prime lane, the discharge of granules is begun while the nozzle is over or opposite the headlap lane so that a constant flow rate can be achieved by the time the nozzle is over the prime lane as described above. Also, the discharge is completed after the nozzle has traversed the prime lane and reached the second extension location to maintain a constant flow rate over the prime lane. This will produce a uniform distribution of granules on the prime lane. As described above, the path of the nozzle can be varied to achieve the desired shape of granule deposit. To increase the production output of shingles, multiple prime lanes may be defined on a single sheet. Three, four or more prime lanes and corresponding headlap lanes may be defined on a single sheet. The nozzle traverses the sheet starting and stopping in extension locations defined in headlap lanes as described above.

Figure 6:
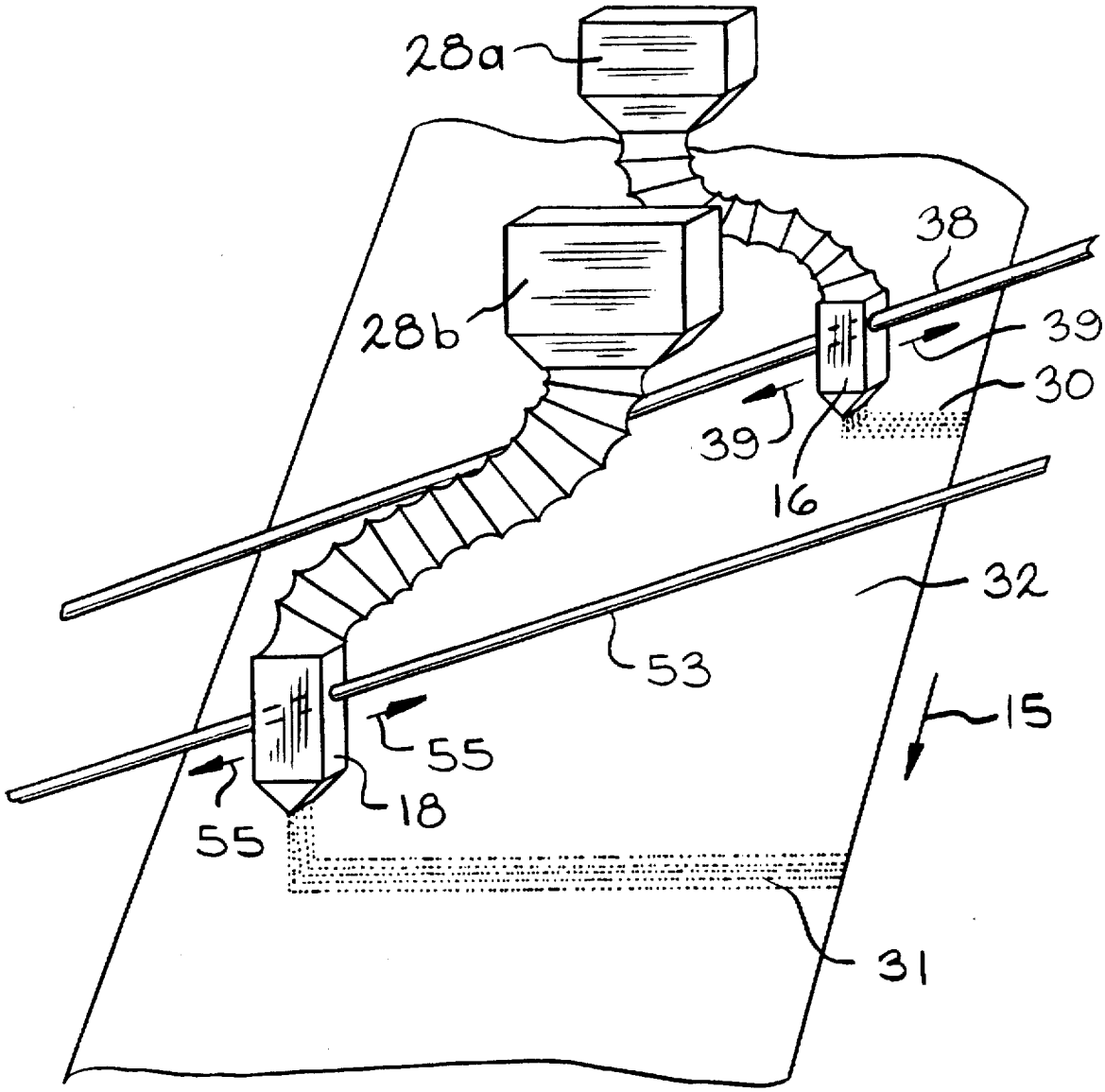
FIG. 6 is a perspective view of apparatus for dispensing granules using two granule dispensing nozzles.

As shown in FIG. 6, both nozzles 16 and 18 can traverse the sheet, simultaneously discharging blend drops 30 and 31 respectively. Nozzle 16 follows a path defined by guide rail 38. As described above the nozzle moves along the path in both directions as indicated by arrows 39 with the discharge of granules occurring as the nozzle traverses in one direction only. Nozzle 18 follows a path as defined by guide rail 53, moving in both directions as indicated by arrows 55. The nozzle 16 is fed by hopper **28*a* and the nozzle 18 is fed by hopper 28*b*. By using 2 nozzles, two different blend drops 30 and 31** can be created. The blend drops can differ in size, shape and color.

The principle and mode of operation of this invention have been described in its preferred embodiment. However, it should be noted that this invention may be practiced otherwise than as specifically illustrated and described without departing from its scope.

INDUSTRIAL APPLICABILITY

The invention can be useful in manufacturing asphalt singles.

I claim:

1. A method of applying granules to an asphalt coated sheet moving in a machine direction, the sheet having a first edge and a second edge, the method comprising providing a nozzle for discharging granules onto the sheet, mounting the nozzle for movement along a path which traverses the sheet and extends beyond the first and second edges defining first and second extension locations beyond the edges, and moving the nozzle along the path, wherein the step of applying the granules includes:

(a) beginning the discharge of the granules from the nozzle in the first extension location so that a constant flow rate of granules is achieved while the nozzle is discharging granules in the first extension location, (b) moving the nozzle across the first edge and along the path to apply granules moving the nozzles to the sheet (c) moving the nozzle across the second edge while maintaining a constant flow of granules so that a constant flow of granules is discharged in the second extension location, and (d) ending the discharge of the granules.

2. The method defined in claim 1 wherein the path is a straight line at an acute angle to the machine direction.

3. The method defined in claim 1 wherein the path is a curved line.

4. The method defined in claim 1 wherein the nozzle moves during discharge at the same speed in the machine direction as the sheet moves, thereby producing a deposit of granules which is in a line generally perpendicular to the machine direction.

5. The method defined in claim 1 further including the step of adjusting the path of the nozzle to establish the shape of the deposit of the granules applied to the sheet.

6. The method defined in claim 5 further including the step of adjusting the speed of the nozzle to establish the shape of the deposit of the granules applied to the sheet.

7. The method defined in claim 6 wherein the steps of adjusting the path and the speed of the nozzle produces a deposit of granules that is in a generally straight line which is perpendicular to the machine direction.

8. A method of applying granules to an asphalt coated sheet moving in a machine direction having at least a first and second headlap lane and a prime lane therebetween, the prime lane and headlap lanes extending in the machine direction, comprising:

(a) beginning the discharge of granules from a nozzle while the nozzle is positioned to deposit granules in the first headlap lane, and maintaining the depositing of the granules in the first headlap lane until a constant flow rate of granules is achieved, (b) moving the nozzle in a path that is transverse to the sheet while depositing granules at the constant flow rate in the prime lane, (c) moving the nozzle beyond the prime lane so that granules are discharged in the second headlap lane while maintaining a constant flow rate of granules, and (d) ending the discharge of granules.

9. The method defined in claim 8 wherein the path is a straight line at an acute angle to the machine direction.

10. The method defined in claim 8 wherein the path is a curved line.

11. The method defined in claim 8 wherein the nozzle moves during discharge at the same speed in the machine direction as the sheet moves, thereby producing a deposit of granules which is in a line generally perpendicular to the machine direction.

12. The method defined in claim 8 further including the step of adjusting the path of the nozzle to establish the shape of the deposit of the granules applied to the sheet.

13. The method defined in claim 12 further including the step of adjusting the speed of the nozzle to establish the shape of the deposit of the granules applied to the sheet.

14. The method defined in claim 13 wherein the steps of adjusting the path and the speed of the nozzle produces a deposit of granules that is in a generally straight line which is perpendicular to the machine direction.

15. A method of producing a shingle comprising providing an asphalt coated sheet moving in a machine direction and having at least a first and second headlap lane and a prime lane therebetween, the prime lane and headlap lanes extending in the machine direction, discharging blend drop granules from a nozzle while moving the nozzle in a path that is transverse to the sheet, wherein the discharging comprises:

(a) beginning the discharge of blend drop granules from the nozzle while the nozzle is positioned to deposit granules in the first headlap lane, and maintaining the depositing of the granules in the first headlap lane until a constant flow rate of blend drop granules is achieved, (b) moving the nozzle in a path that is transverse to the sheet while depositing blend drop granules at the constant flow rate in the prime lane, (c) moving the nozzle beyond the prime lane so that blend drop granules are discharged in the second headlap lane while maintaining a constant flow rate of blend drop granules, (d) ending the discharge of blend drop granules, and (e) discharging background granules onto the sheet.

16. The method defined in claim 15 wherein the path is a straight line at an acute angle to the machine direction.

17. The method defined in claim 15 wherein the path is a curved line.

18. The method defined in claim 15 wherein the nozzle moves during discharge at the same speed in the machine direction as the sheet moves, thereby producing a deposit of granules which is in a line generally perpendicular to the machine direction.

19. The method defined in claim 15 further including the step of adjusting the path and the speed of the nozzle to establish the shape of the deposit of the blend drop granules applied to the sheet.

20. The method defined in claim 19 wherein the step of adjusting the path and the speed of the nozzle produces a deposit of blend drop granules that is in a generally straight line which is perpendicular to the machine direction.

* * * * *